United States Patent [19]

Gust et al.

[11] Patent Number: 4,488,356

[45] Date of Patent: Dec. 18, 1984

[54] METHOD OF MAKING ELECTRICAL CONTACTS

[75] Inventors: Edward W. Gust, Pittsburgh; Robert F. Levendosky; William A. Hochella, both of Westmoreland, all of Pa.

[73] Assignee: GTE Products Corporation, Stamford, Conn.

[21] Appl. No.: 481,505

[22] Filed: Apr. 1, 1983

[51] Int. Cl.[3] ..... H01R 43/04

[52] U.S. Cl. ..... 29/882; 200/267; 29/522 R

[58] Field of Search ..... 29/882, 874, 881, 876, 29/417, 522 R; 200/268, 278, 294

[56] References Cited

U.S. PATENT DOCUMENTS

| | | |
|---|---|---|
| 2,373,861 | 4/1945 | Van Inwagen, Jr. . |
| 2,646,613 | 7/1953 | Enzler . |
| 2,715,169 | 8/1955 | High . |
| 2,854,074 | 9/1958 | Frank et al. . |
| 2,937,434 | 5/1960 | Swift . |
| 3,397,453 | 8/1968 | Gwyn, Jr. . |
| 4,259,557 | 3/1981 | Takako . |

FOREIGN PATENT DOCUMENTS

| | | |
|---|---|---|
| 170577 | 10/1934 | Switzerland . |
| 815136 | 6/1959 | United Kingdom . |
| 2072057 | 9/1981 | United Kingdom . |

*Primary Examiner*—Howard N. Goldberg
*Assistant Examiner*—Carl J. Arbes
*Attorney, Agent, or Firm*—J. Theodosopoulos

[57] ABSTRACT

This invention concerns a method of making electrical contact buttons comprising the steps of presenting a strip of clad metal having a width narrower than the diameter of a finished contact electrical contact button and having a thickness greater than the thickness of the finished electrical contact button to a coining operation where the strip is successively pressed between a coining punch and a coining die to successively plastically deform uniformly spaced apart portions of the strip into the configuration of the electrical contact button. Tranverse ribs are then formed in the spaces between contact buttons in order to prevent forward flow of the metal during plastic deformation thereof. The electrical contacts are then punched out of the strip.

6 Claims, 4 Drawing Figures

METHOD OF MAKING ELECTRICAL CONTACTS

This invention is concerned with the manufacture of disk-shaped electrical contacts, sometimes called contact buttons. Such contacts often comprise a noble metal contact face, usually of silver or silver-containing material, with a backing of a metal suitable for mechanical and electrical attachment, for example, by welding to a support. There is often an intermediate layer there between of a material, for example, copper, having good electrical conductivity. Examples of such electrical contacts are shown in U.S. Pat. Nos. 3,574,570, 3,397,454, 3,358,364, 3,252,207 and 3,191,275.

In the prior art the manufacture of such electrical contact buttons often involved the use of at least two machines. First, a circular blank would be punched out of a sheet of clad metal. Then, the blank would be coined to the desired shape in a second machine.

This invention describes a process in which the contact buttons can be made in a single machine with advantages in cost and production rates. The process commences with a long strip of clad metal, the width of which is less than the diameter of the finished contact button and the thickness of which is greater than the thickness of the finished contact button. In a coining step, the strip is pressed between a coining punch and a coining die during which the strip is pressed out, that is, plastically deformed, to a width greater than the diameter of the finished contact button and also during which the strip is coined to form a contact button of the desired configuration. In the next operation, a narrow transverse section of the strip between the contact buttons is deformed, that is, pressed, into the shape of a rib. The rib prevents forward flow of the metal during the time that the metal is being plastically deformed during coining, and therefore aids in precisely positioning the strip for a blanking operation during which each contact button is accurately punched out of the strip.

In summary, this invention is a method of making electrical contact buttons comprising the steps of presenting a strip of clad metal having a width narrower than the diameter of a finished contact electrical contact button and having a thickness greater than the thickness of the finished electrical contact button to a coining operation where the strip is successively pressed between a coining punch and a coining die to successively plastically deform uniformly spaced apart portions of the strip into the configuration of the electrical contact button, then successively forming transverse ribs in the spaces between contact buttons to check forward flow of the metal during plastic deformation thereof, and then punching the electrical contact buttons out of the strip.

Figure 1:
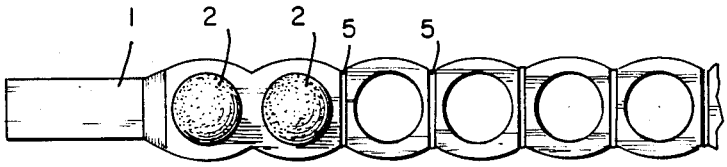
Figure 2:
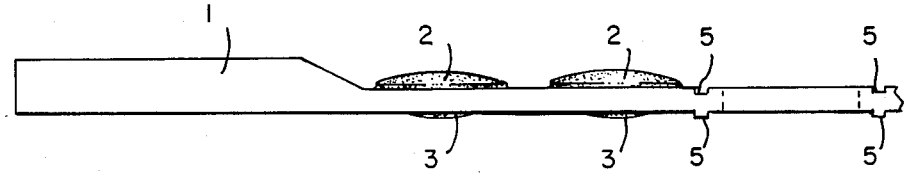
Figure 3:
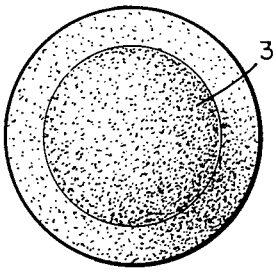
Figure 4:
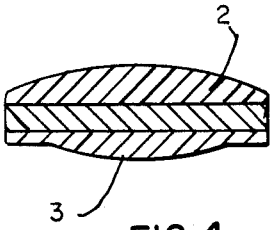

In the drawing, FIG. 1 is an elevational view of a strip of clad metal being formed into contact buttons, and FIG. 2 is a side view thereof. FIG. 3 and FIG. 4 show a finished contact button.

In a specific example, strip 1 was 86 mils thick by 187 mils wide and comprised: (1) a clad metal consisting of a contact layer of silver or silver containing material the thickness of which was 37½% of the 86 mil thickness; (2) an intermediate layer of copper the thickness of which was 50% of the 86 mil thickness; and (3) a backing layer of low carbon steel or stainless steel the thickness of which was 12½% of the 86 mil thickness.

In the coining station, strip 1 was pressed out to a width of 308 mils and a thickness outside the contact button area of 35 mils. Contact button 2 was 64 mils thick at its maximum thickness by 250 mils diameter. On the backing layer of contact button 2 there was formed a slightly raised radiused projection 3, which was about 156 mils diameter by 5 to 8 mils peak height. The purpose of projection 3 is to provide for resistance welding of the contact button to another attachment or component. The die used in the coining station had an angle thereon which formed angle on strip 1 at the transition region between the pressed and unpressed portions of strip 1. The size of angle 4 is important in providing enough metal to completely fill the die cavity during coining with a minimum of excess of metal. In this example, angle 4 is preferably about 30° to 35°.

In the next station, a transverse rib 5 is pressed into strip 1 between contact button 2. Rib 5 is important for the following reason. During coining the metal is pressed out and displaced in all directions, forwards, backwards and sidewards. However, the strip must move an identical distance between stations during the manufacture of the contact buttons. Therefore the forward flow of the metal during coining must be checked. This is accomplished by rib 5. In this example the width and depth of rib 5 were 28 and 13 mils, respectively.

Subsequently, each contact button 2 is blanked, i.e., punched out of strip 1. In this example the punch was 249 mils diameter and the mating female die was 144 mils diameter.

I claim:

1. The method of making electrical contact buttons comprising the steps of:

presenting a strip of clad metal having a width narrower than the diameter of a finished electrical contact button and having a thickness greater than the thickness of said finished electrical contact button to a coining operation;

successively pressing the strip of clad metal in the coining operation between a coining punch and a coining die to successively plastically deform uniformly spaced apart portions of the strip into the configuration of the electrical contact button;

successively pressing a rib shaped die into the strip in the spaces between contact buttons to form a transverse rib in the strip which is capable of checking forward flow of the clad metal during the preceding pressing step wherein the clad metal is plastically deformed into the configuration of the electrical contact button;

and punching the electrical contact buttons out of the strip.

2. The method of claim 1 wherein an angle is formed on the strip at the transition region between the pressed and unpressed portions of the strip during the covering operation.

3. The method of claim 2 wherein said angle is about 30° to 35°.

4. The method of claim 1 wherein the clad metal comprises a contact layer and a backing layer.

5. The method of claim 4 wherein a slightly raised radiused projection is formed in the backing layer during the coining operation to provide for resistance welding of the contact button to another attachment or component.

6. The method of claim 1 wherein the contact metal comprises a noble-metal-containing contact layer, a copper-containing intermediate layer, and a steel-containing backing layer.

* * * * *